US009631376B2

(12) United States Patent
Mowers et al.

(10) Patent No.: US 9,631,376 B2
(45) Date of Patent: Apr. 25, 2017

(54) TRANSITION FOR VINYL TILE AND CARPET TILE

(71) Applicant: Tarkett USA Inc., Solon, OH (US)

(72) Inventors: Terrance Arthur Mowers, Chattanooga, TN (US); Curt Johnston, Chagrin Falls, OH (US)

(73) Assignee: Tarkett USA Inc., Solon, OH (US)

( * ) Notice: Subject to any disclaimer, the term of this patent is extended or adjusted under 35 U.S.C. 154(b) by 0 days.

(21) Appl. No.: 14/948,435

(22) Filed: Nov. 23, 2015

(65) Prior Publication Data

US 2016/0145878 A1 May 26, 2016

Related U.S. Application Data

(60) Provisional application No. 62/083,764, filed on Nov. 24, 2014.

(51) Int. Cl.
*E04F 19/00* (2006.01)
*E04F 19/06* (2006.01)
*E04F 19/02* (2006.01)

(52) U.S. Cl.
CPC ..... *E04F 19/061* (2013.01); *E04F 19/02* (2013.01); *E04F 19/06* (2013.01)

(58) Field of Classification Search
CPC ..... E04F 19/02; E04F 19/06
USPC ..... 52/716.1; 428/49, 58, 119, 131
See application file for complete search history.

(56) References Cited

U.S. PATENT DOCUMENTS 1,722,660 A 7/1929 Connelly
1,936,224 A 11/1933 Awbrey
D128,793 S 8/1941 Bonnell
2,258,314 A 10/1941 Bonnell
2,820,980 A 1/1958 Karas
2,926,378 A * 3/1960 Eichhorn ..... A47G 27/0462 16/4
2,927,339 A 3/1960 Grunwald
2,980,943 A * 4/1961 Calandro ..... A47G 27/0462 16/16
3,003,185 A * 10/1961 Grunwald ..... A47G 27/045 16/16
3,514,914 A 6/1970 Bergquist
3,745,606 A * 7/1973 Matthey ..... A47G 27/06 16/10
5,087,488 A * 2/1992 Cakmakci ..... B29C 47/0019 264/177.1
5,342,666 A * 8/1994 Ellison ..... B29C 45/1418 428/174
D364,233 S * 11/1995 Caley ..... D25/119
D364,234 S 11/1995 Caley
D368,969 S 4/1996 Davies
(Continued)

OTHER PUBLICATIONS

Tarkett/Johnsonite 2012 product brochure: The Ultimate Flooring Experience, Slim Line Transitions, p. Solve for X | 9.177, with front and back covers.

*Primary Examiner* — Brian Glessner
*Assistant Examiner* — Paola Agudelo
(74) *Attorney, Agent, or Firm* — Walter | Haverfield LLP; D. Peter Hochberg; Sean F. Mellino

(57) ABSTRACT

The invention relates to a transition for use between vinyl tile and carpet tile when they are installed on a floor and includes a vertical post having a tail extending from a tile-facing side, an upper cap having a lip overhanging the tail, and a carpet-facing side devoid of a tail and a lip.

9 Claims, 4 Drawing Sheets

(56) References Cited

U.S. PATENT DOCUMENTS

| | | | | |
|---|---|---|---|---|
| 5,756,176 | A * | 5/1998 | Feld | A47G 27/045 16/16 |
| 5,766,726 | A * | 6/1998 | Bannister | A47G 27/045 16/16 |
| 138,323 | A | 10/2000 | Thørgersen | |
| 6,550,192 | B1 | 4/2003 | Nelson et al. | |
| 6,818,305 | B2 * | 11/2004 | Murar | B29C 43/203 428/412 |
| 7,784,238 | B2 | 8/2010 | Bannister | |
| 7,797,900 | B2 * | 9/2010 | Sondermann | E04F 19/062 52/287.1 |
| 8,844,231 | B2 * | 9/2014 | Urban, Jr. | E04F 19/063 16/7 |
| 8,966,841 | B2 * | 3/2015 | Rissone | E06B 1/70 49/467 |
| 2005/0189723 | A1 * | 9/2005 | Chassee | A47G 27/045 277/411 |
| 2007/0000195 | A1 * | 1/2007 | Garces | B44C 5/00 52/204.61 |
| 2008/0063864 | A1 * | 3/2008 | Aisenbrey | B29B 9/14 428/364 |

* cited by examiner

TRANSITION FOR VINYL TILE AND CARPET TILE

CROSS-REFERENCE TO RELATED APPLICATIONS

This application claims benefit of U.S. Provisional Application No. 62/083,764 filed Nov. 24, 2014, which is incorporated herein by reference in its entirety.

BACKGROUND OF THE INVENTION

Field of the Invention

This invention relates to floor coverings and, in particular, to transitions between tile and carpet, and more particularly, transitions between vinyl tile and carpet tile when they are installed on a floor.

Description of the Prior Art

Transitions are known for providing a smooth transition between the interface of different types of floor covering, such as between adjacent pieces of carpeting, carpeting and tile, tile and carpet tile, and the like. Floor transitions, or transitions, are used for many reasons. For one, they provide an aesthetic appearance since they many times provide a smooth border between two types of floor coverings. Another reason is for safety since, if the two floor coverings have different heights, it is possible that a person crossing the border between the two types of floor coverings may trip if these coverings are at different heights. Additionally, if they are in places where wheeled carts travel, such as in hospitals where gurneys, bedside carts, medical carts, food service carts, instruments carts and the like are used, a smooth overlay between different heights of adjacent floor coverings avoid uncomfortable jostling and sometimes dangerous movement. Furthermore, providing a transition will lessen the discernment of changes in a floor surface by persons walking from one floor covering to another since they are less likely to feel the difference between rigid and carpeted floors.

There are many types of transitions within the art. U.S. Pat. No. 2,258,314 provides an edge molding for securing the edge of carpets, linoleum or other floor or wall coverings to the surface to be ornamented or protected. This of molding is large, readily noticeable and somewhat difficult to install. A rather complex device is shown in U.S. Pat. No. 2,820,980, which provides a combined binding and anchoring portion for protecting the marginal edge of floor coverings, such as carpet and the normal floor, and requires the use of fasteners to secure the device to the floor. Another carpet holder strip is shown in U.S. Pat. No. 2,926,378, which can be used in pairs or individually between separate items of carpeting, but is also very noticeable and requires that the carpeting be of equal heights. A carpet-hard floor joint cover is disclosed in U.S. Pat. No. 2,980,943, which includes an elongated joint strip which can be bent in order to provide a transition between two types of floor covering, but it is very noticeable and also rather complex. A transition strip for providing a transition between the margin of a rigid flooring and the margin of adjacent carpeting is described in U.S. Pat. No. 5,756,176 but is noticeable and includes structure for receiving cementitious material for holding tiles thereto. In U.S. Pat. No. 5,766,726 a resilient, semi-rigid molding strip is provided for installation along the edge of a linoleum floor surface and carpeting, but it provides a flat, readily noticeable upper surface between the two types of flooring.

Turning next to U.S. Pat. No. 6,550,192, molding strips are provided for covering an interface between tile and the floor upon which the tile is mounted. This molding has a number of components and is very noticeable when in use. There is a variable height, interlocking molding strip disclosed in U.S. Pat. No. 7,784,238 which includes an elongate cap portion having opposing laterally-extending flange portions and an elongate, relatively thick depending wall portion that extends downwardly and has extending from it a series of horizontal rib portions which are engaged in a U-shaped channel portion when in use. This is a relatively large unit having two separate elements and is very noticeable when in use. Another noticeable unit is a transition strip which extends from a support which is disclosed in U.S. Publication No. 2005/0189723 which has a generally planar support surface which is fairly long and extends along a floor base, a vertical wall extending from an end of the floor base across which is a cap which includes a cantilevered construction and extends slightly downwardly towards the top of a carpet, and an opposing cap portion extending from the other side of the vertical wall for covering a flooring section. The entire cap is fully in view when installed.

There are various transitions for use between tile floors and carpeting, including those for use between hard tiles and carpet tiles. In some situations, an upstanding wall is provided from which extends in one direction a tail or base portion, the bottom of which is flat, for resting on the floor, and the tail having an upper section which is an inclined surface starting somewhat higher from the base of the wall and extending downwardly to the free end of the tail for extending between floor levels of different heights. A cap is provided having an overhang which extends outwardly from the wall for providing an overhang for the side of the wall without the tail and a lack of an overhang on the side of the wall with the tail. In the latter know transition, the overhang rests on top of the carpeting so that the top of the entire cap is visible when this known transition is in use. Furthermore, the tail normally extends under the carpet.

SUMMARY OF THE INVENTION

An object of the present invention is to provide a transition between a hard flooring surface and a carpet floor covering.

Another object of the present invention is to provide a transition between a tile floor covering and a carpet floor covering.

It is another object of the present invention to provide a transition between a vinyl tile and a carpet tile.

It is yet a further object of the present invention to provide a transition between a tile and a carpet tile which is less noticeable than prior transitions between tiles and carpets, including carpet tiles.

It is yet a further object of the present invention to provide an effective and efficient transition between vinyl tiles and carpets, including carpet tiles, which is relatively easy to manufacture, aesthetic and effective in use and simple to install and use.

DESCRIPTION OF THE PREFERRED EMBODIMENTS

Figure 1:
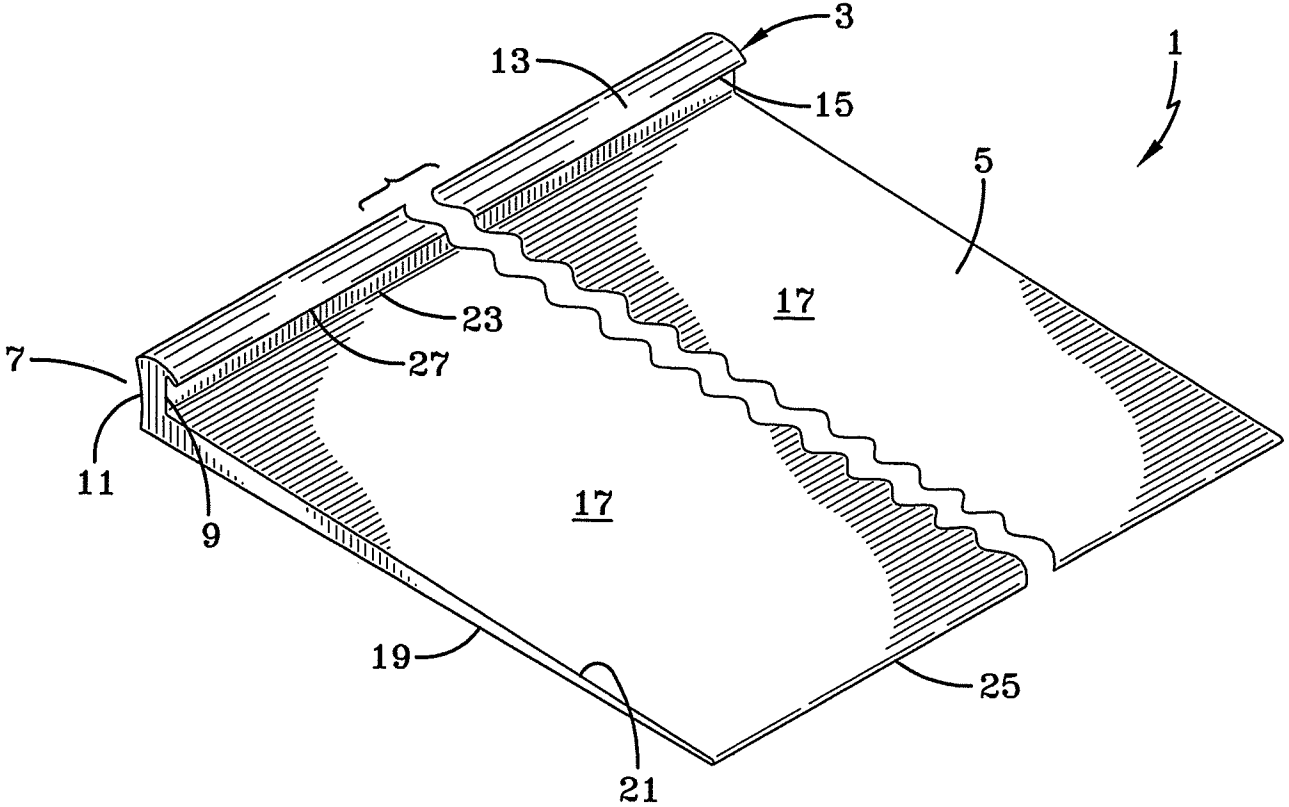
FIG. 1 is a perspective view of a transition for use with vinyl tiles and carpet tiles according to a preferred embodiment of the invention.
Figure 2:
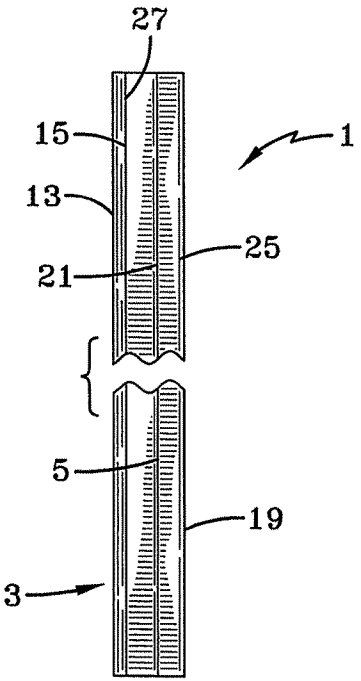
FIG. 2 is one front view of the transition shown in FIG. 1.
Figure 3:
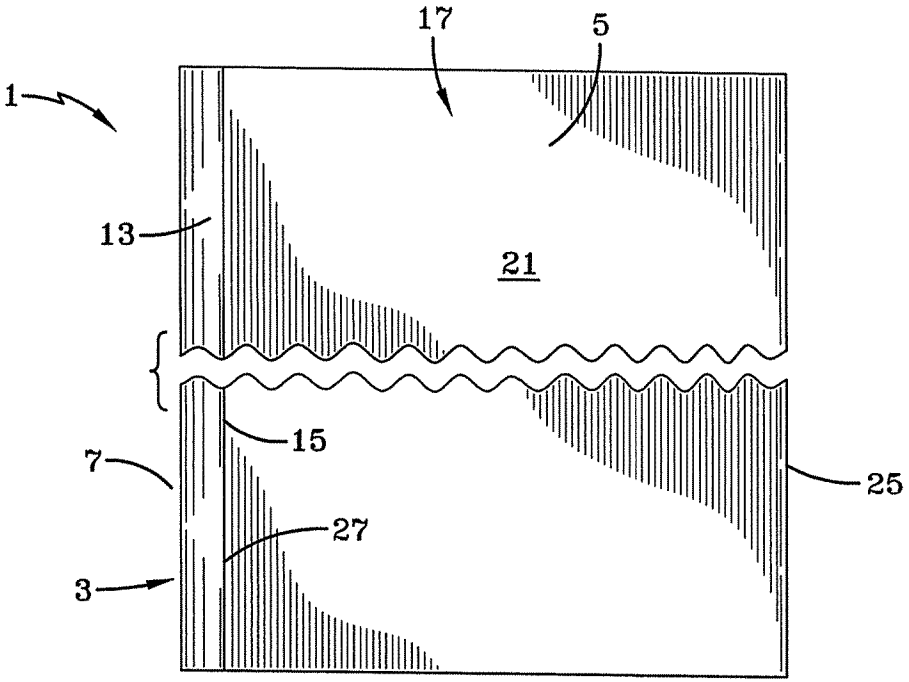
FIG. 3 is a top view of the transition shown in FIG. 1.
Figure 4:
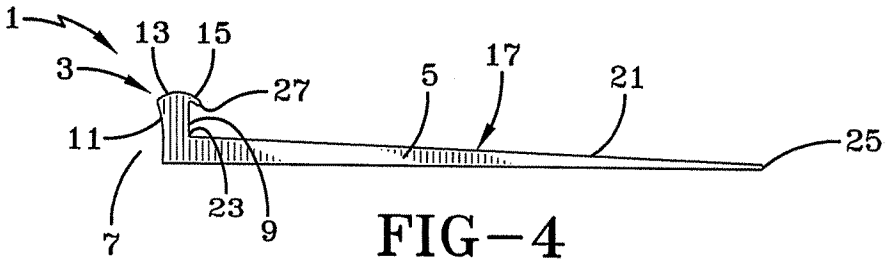
FIG. 4 is one side view of the transition shown in FIG. 1.
Figure 6:
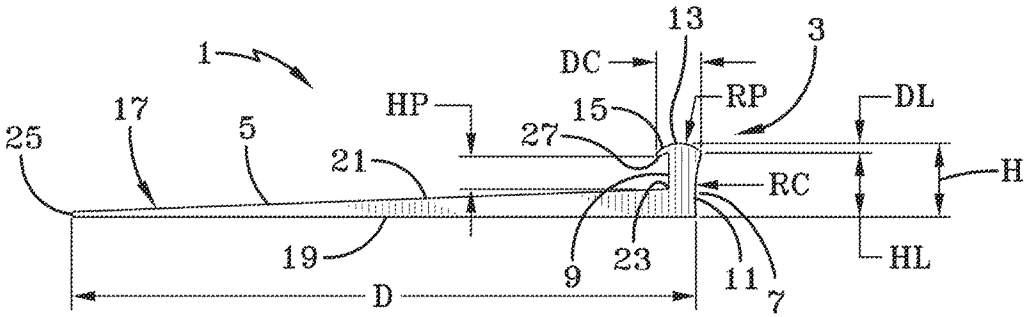
FIG. 6 is a side view opposite the side shown in FIG. 4 of the transition shown in FIG. 1.
Figure 5:
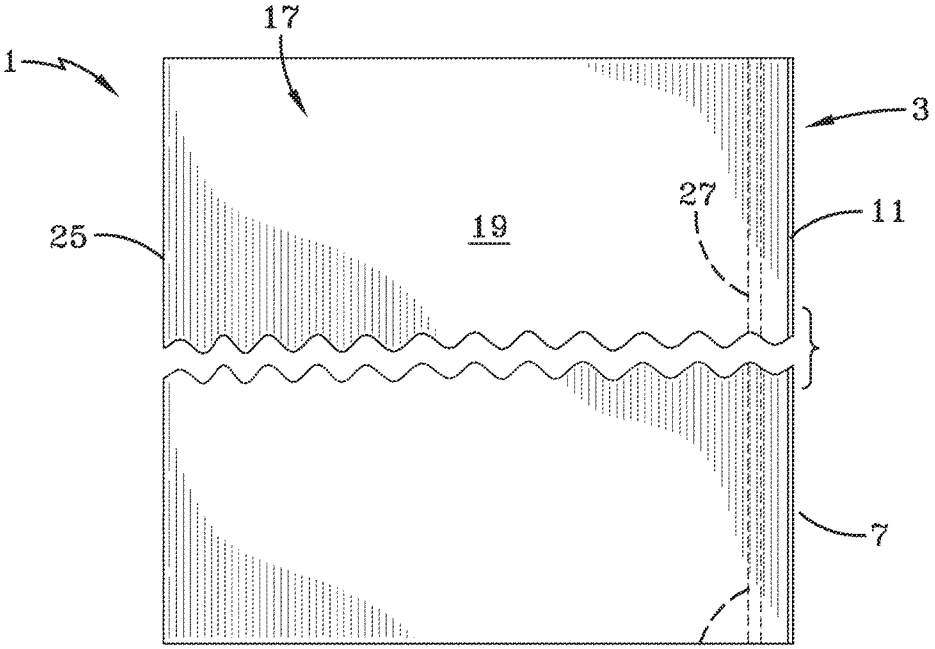
FIG. 5 is a bottom view of the transition shown in FIG. 1.
Figure 7:
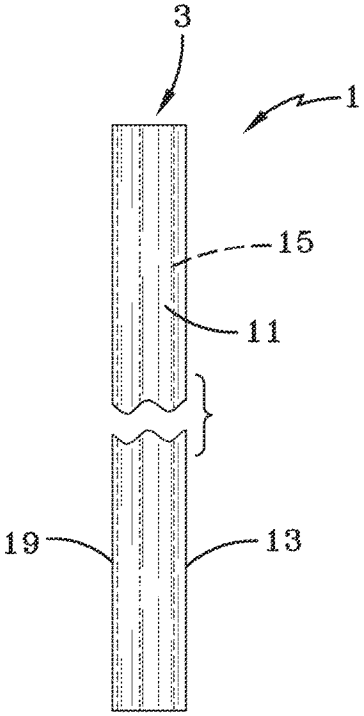
FIG. 7 is a front view of the transition shown in FIG. 1 taken from the front of the transition opposite the front view shown in FIG. 2.

A transition 1 for a vinyl tile and carpet tile is shown in each of FIGS. 1-8. Transition 1 includes an upstanding post or vertical wall 3 having a tile portion 5 and a carpet tile portion 7. Wall 3 has a flat base portion. Post 1 has a tile-facing side 9 and a carpet tile-facing side 11. tile-facing side 9 is preferably flat. Thus, vertical wall 3 has a flat, planar vertical wall base portion. A rounded cap 13 forms the top of post 3, and cap 13 has a lip 15 which extends partly over tile-facing side 9 and carpet side edge. Cap 13 therefore has a convex curve extending between lip 15 and the carpet side edge. The carpet side edge of cap 13 joins carpet-facing side 11 and is devoid of an overhang from cap 13.

A base portion or tail 17 extends from the lower part of vertical post 3 from tile-facing side 9. Tail 17 has a flat bottom 19 which extends from the flat bottom of vertical post or wall 3. Tail 17 is inclined downwardly from an upper portion 21 which has a raised intersection 23 with tile-facing side 9 of vertical wall 3. Tail 17 has a free end 25 and top 21 of tail 17 extends from tile-facing side 9 to free end 25. Tail 17 serves as both a base support for a vinyl tile resting thereon as well as being a leveler for provide a narrow incline from a vinyl tile to the raised surface of a carpet tile. The transition is a leveler which eases traversing the surface of the tile and the surface of the carpet tile and would prevent jolts and possible stubbing of a foot which might otherwise occur in traversing the tile-to-carpet interface. This is a reason that tail 17 is rather long in length as discussed further below.

Figure 8:
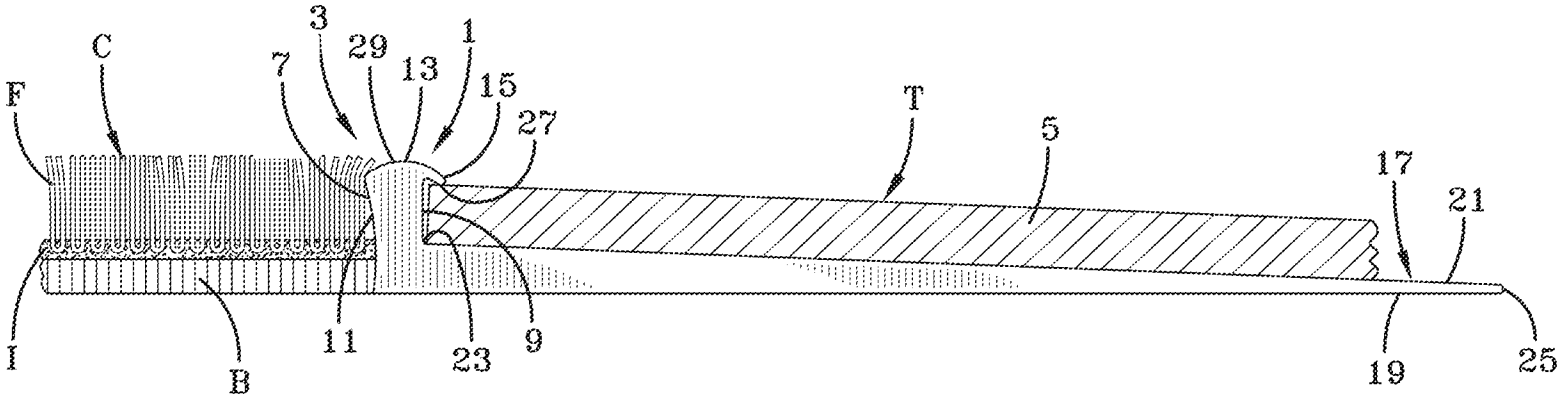
FIG. 8 is a side view of the transition shown in FIG. 1 in use by providing a transition between a vinyl tile and carpet tile.

An example of use of transition 1 is shown in FIG. 8. A tile T is shown resting on tail 17 and extends beneath lip 15. Lip 15 has a rounded nose portion 27. The base of tile T is slightly raised along top 21 of tail 17 from free end 25 to intersection 23. A carpet tile C extends from carpet tile-facing side 11 of vertical wall 3. Carpet tile-facing side 11 can have a concave curve having a top curved portion proximal cap 13 and a bottom curved portion proximal a flat base portion of vertical wall 3, or carpet tile-facing side can be flat and could be inclined away from tail 17. Carpet tile C rests on a subfloor B on which is disposed an intermediate backing I from which extend carpet fibers F. It can be seen that carpet fibers F extend to an upper level 29 of cap 13 which renders cap 13 partly noticeable to persons viewing the interface between the carpet tile C and tile T, since cap 13 is preferably aesthetic and can have a pleasing appearance to observers of cap 13.

The construction and functioning of transition 1 is reversed from similar prior art transitions. Under the prior art, tile T would abut carpet tile-facing side 11 of vertical wall 3 and carpet tile C would ride on tail 17 and extend beneath lip 15. This prior arrangement would leave cap 13 fully noticeable, since it would not be covered at all by fibers F. Furthermore, since tile 7 rests on tail 17, transition 1 need not be noticeable when in use.

The dimensions of transition 1 can vary according to the tiles and carpet tile (or carpet) with which transition 1 is used. For example, with reference to FIG. 6 the following chart indicates four examples of dimensions for transition 1:

| Component Name in Inches | Symbol | Example 1 (in inches) | Example 2 (in inches) | Example 3 (in inches) | Example 4 (in inches) |
|---|---|---|---|---|---|
| Height (in inches) | H | 0.293 | 0.250 | 0.293 | 0.250 |
| Height of nose 27 of cap 13 | HL | 0.255 | 0.208 | 0.255 | 0.203 |
| Depth of tail | D | 2.500 | 2.500 | 2.500 | 2.500 |
| Depth of lip 15 | DL | 0.038 | 0.042 | 0.038 | 0.047 |
| Radius carpet tile side 11 | RC | 0.627 | 0.485 | 0.627 | 0.485 |
| Radius of cap 13 | RP | 0.164 | 0.125 | 0.164 | 0.125 |
| Height at tile side 9 of intersection 23 from lip 15 | HP | 0.145 | 0.145 | 0.130 | 0.130 |
| Depth of cap | DC | 0.179 | 0.180 | 0.179 | 0.180 |

In operation, transition 1 would be attached to a subfloor by means of an appropriate adhesive applied to the bottom of tail 17 and the bottom of post 3. Transition 1 would ordinarily be made in 12 foot lengths. Tile T and carpet tile C would be laid in the conventional manner. The difference in the dimensions shown above relate to the different heights of commercial carpet tile depending on pile height and carpet tile pattern. Transition 1 is preferably made from flexible polyvinylchloride (PVC).

Commercial transition for vinyl tile and carpet tile have been successfully introduced into the market. The following are the product specifications for two of the foregoing products:

Product No. 1
Abrasion Resistance: ASTM D 3389—0.22 mg/cycle
Accessibility: ADA Compliant (Section 4.5.2—Changes of Level)
Adhesive: Tandus Centiva CENTI 6000 SP Special Purpose Adhesive
Dimensions: 3/16" (4.7 mm) cap with 1/8" (3.2 mm) wide support
Fire Resistance: ASTM E 648/NFPA 253 (Critical Radiant Flux)—Class 1
Hardness: ASTM D 2240—Not less than 85 Shore A
Installation: 1/8" (3.2 mm) LVT materials to ER3 Modular
Length: 12 ft (3.66 m)
Slip Resistance: ASTM D 2047—Exceeds Federal Standards and ADA recommendations
Construction PVC Product No. 2
Abrasion Resistance: ASTM D 3389—0.22 mg/cycle
Accessibility: ADA Compliant (Section 4.5.2—Changes of Level)
Adhesive: Tandus Centiva CENTI 6000 SP Special Purpose Adhesive
Dimensions: 3/16" (4.7 mm) cap with 1/8" (3.2 mm) wide support
Fire Resistance: ASTM E 648/NFPA 253 (Critical Radiant Flux)—Class 1
Hardness: ASTM D 2240—Not less than 85 Shore A
Installation: 1/8" (3.2 mm) LVT materials to ethos and Conserv Modular
Length: 12 ft (3.66 m)
Warranty: 2 year
Construction: PVC Tandus Centiva CENTI 6000 SP Special Purpose Adhesive is a water-based adhesive for rubber and vinyl tiling, and can be obtained from Tandus Centivea Inc. of Dalton, Ga.

In order to properly install the foregoing Product No. 1 and Product No. 2, the following steps should be taken for installing the inventive transition between a carpet tile and a luxury vinyl tile (LVT):

1. Install the transition with the flange of the transition located under the LVT material;
2. Cut the transition to the required length with a molding cutter or a utility knife;
3. Apply CENTI 6000AP adhesive to the floor surface area of porous subfloors. Using a 1/16×1/16×1/16 inch square notched trowel;
4. Allow the adhesive to remain open for 5-10 minutes before placement of the molding after the preceding step is complete;
5. Apply CENTI 6000 SP adhesive to the floor surface area using non-porous subfloors using a 1/32×1/16×1/32 inch U-notched trowel;
6. Allow the adhesive to dry to the touch (little or no transfer of adhesive to the finger) before placement of the transition;
7. Carefully position and install the transition by using a small hand roller to roll the transition to ensure proper adhesive bond, although the transition cannot be repositioned once contact is made with the subfloor surface;
8. Feather the flange edge of the transition to the substrate;
9. Apply the recommended LVT adhesive to the substrate and the flange of the transition and allow for proper open time;
10. Cut the LVT so its fits snugly under the lip of the transition; and
11. Cut the tiles so they fit snugly to the face of the transition, opposite the LVT.

The commercial transitions according to the present invention have been constructed to render them particularly attractive. It has been found that the surface of cap 13, which is the only visible portion of the transition once it has been installed between vinyl tiles and carpet tiles, is by co-extruding a top coat with a metallic fragment. The top coat is preferably 0.010 inches thick. The metallic fragment is particularly pleasing to view as installed, and provides an attractive metallic stripe on the floor to which the inventive transition has been installed. There are different types of metallic fragments which can be used for this purpose. With particular reference to Products No. 1 and Product No. 2, particular care should be taken to obtain the best results. All subfloors should be clean, smooth, dry and flat. The surface of the subfloors should be free of all dust, loose particles, solvents, paint, grease, oil, wax, alkali, sealing-curing compounds, old adhesives, and any other foreign material which could affect installation of the inventive transitions described above. If the subfloors are made from concrete, the concrete should be constructed as recommended by the American Concrete Institute's ACI 302.2 "Guide for Concrete Slabs that Receive Moisture-Sensitive Flooring Materials," prepared according to ASTM FF 710 "Standard Practice for Preparing Concrete Floors to Receive Resilient Flooring." Wood subfloors should have a minimum of 18 inches of cross-ventilated space between the bottom of the joist and ground. Terrazzo and ceramic floor surfaces should be thoroughly sanded to remove all glaze and waxes, and loose tiles should be replaced and grout line be cleaned. It has been found that steel floor surfaces should be mechanically abraded to assist with the adhesive bond.

Although transition 1 has been developed for use with vinyl tile (or more specifically, luxury vinyl tile), it could be used with any kind of hard tile. Likewise, although the transition was also prepared for commercial use for carpet tile, it could be used with any other type of carpet as well.

Transitions according to the present invention are preferably made using extrusion techniques of the type used for similar transitions and can be made without special molding techniques. The transitions according to the present invention can be installed by persons with ordinary skill in the art of installing transitions, and the invention in its preferred form is attractive, efficient, effective and economical to manufacture and use.

The invention has been described above with particular emphasis on the preferred embodiment, but variations and modifications within the spirit and scope of the claims will be understood by those skilled in the art to which the invention pertains.

The invention claimed is:

1. A one-piece transition for providing a transitional item for use at the interface of tiles and carpet tiles, said transition comprising:

a vertical wall including:

a flat wall base portion at the underside of said vertical wall;

a wall top portion;

a carpet-facing side, said carpet-facing side being devoid of a tail;

a tile-facing side on the opposite side of said vertical wall from said carpet-facing side, said tile-facing side having a tile-facing side bottom portion; and a tile-facing side top portion and a tile-facing side intermediary portion; and a tail extending from said tile-facing side, said tail having a tail top, a tail bottom opposite said tail top, a wall connection end and a free end;

said tail bottom being flat, continuous and coplanar with said flat base portion of said vertical wall for engaging a flat floor surface and extending from said vertical wall to said free end, and a tail top portion extending from said tile-facing side intermediary portion of said tile-facing side and being inclined downwardly from said tile-facing side intermediary portion towards said tail bottom to an intersection with said tail bottom to define said free end; and a cap on the wall top portion, said cap having a continuously curved upper portion extending between said carpet-facing side and said tile-facing side of said vertical wall and including a lip overhanging a portion of said tail, said lip being proximate said tile-facing side of said vertical wall, and said cap having a carpet side edge on the side opposite of said cap from said lip, wherein said cap does not overhang said carpet-facing side of said vertical wall, and wherein said lip intersects said tile-facing side and for ms a sharp corner with said tile-facing side;

said lip comprises a lip underside facing both said tile top and said tile-facing side of said vertical wall;

wherein said carpet-facing side of said vertical wall is configured to have a shape selected from the group consisting of a concave curved surface, and a flat surface inclined away from said tail; and wherein said concave curved surface of said carpet-facing side includes a top curved portion terminating at said cap and a bottom curved portion terminating at said flat wall base portion.

2. A transition according to claim 1 wherein said tile-facing side of said vertical wall is flat.

3. A transition according to claim 1 wherein said vertical wall has a flat, planar vertical wall base portion, and said tail bottom is coplanar with said flat planar vertical wall base portion.

4. A transition according to claim 1 wherein said cap has a top coat with metallic fragments.

5. A transition according to claim 4 wherein said transition is an extruded transition, and said top coat is co-extruded with said transition.

6. A transition according to claim 1 wherein said transition is made from flexible polyvinyl chloride (PVC) and includes the following product specification:

Abrasion Resistance: ASTM D 3389-0.22 mg/cycle

Accessibility: ADA Compliant (Section 4.5.2-Changes of Level)

Fire Resistance: ASTM E 648/NFPA 253 (Critical Radiant Flux)-Class 1

Hardness: ASTM D 2240-Not less than 85 Shore A.

7. A one-piece transition for providing a transitional item for use at the interface of tiles and carpet tiles, said transition comprising:

a vertical wall including:

a flat wall base portion at the underside of said vertical wall;

a wall top portion;

a carpet-facing side, said carpet-facing side being devoid of a tail;

a tile-facing side on the opposite side of said vertical wall from said carpet-facing side, said tile-facing side having a tile-facing side bottom portion; said tile-facing side comprising:

a tile-facing side top portion and a tile-facing side intermediary portion;

and a tail extending from said tile-facing side, said tail having a tail top, a tail bottom opposite said tail top, a vertical wall connection end and a free end;

said tail bottom being flat, continuous and coplanar with said flat base portion of said vertical wall for engaging a flat floor surface and extending from said vertical wall to said free end, and a tail top portion extending from said tile-facing side intermediary portion of said tile-facing side and being inclined downwardly from said tile-facing side intermediary portion towards said tail bottom to an intersection with said tail bottom to define said free end; and a cap on the wall top portion, said cap including a lip overhanging a portion of said tail and not overhanging said carpet tile-facing side of said vertical wall, said lip being proximate said tile-facing side of said vertical wall, and said cap having a carpet side edge on the side opposite of said cap from said lip;

wherein said lip comprises a lip underside facing both said tile top and said tile-facing side of said vertical wall.

8. The combination of a one-piece transition, a tile and the selected one of the group consisting of a carpet and carpet tiles resting on a subfloor, said one-piece transition providing a transitional item for use at the interface of said tiles and the selected one of the group consisting of a carpet and carpet tiles resting on a subfloor, said transition comprising:

a vertical wall including:

a flat wall base portion at the underside of said vertical wall;

a wall top portion;

a carpet-facing side, said carpet-facing side being devoid of a tail, said carpet-facing side comprising a lower portion for engaging the bottom of a carpet in the event said transition is in use with said carpet, and for engaging said subfloor in the event said transition is in use with said carpet tiles resting on a subfloor;

a tile-facing side on the opposite side of said vertical wall from said carpet-facing side said tile-facing side comprising:

a tile-facing side bottom portion; and a tile-facing side top portion; and a tile-facing side intermediary portion; and a tail extending from said tile-facing side, said tail having a tail top, a tail bottom opposite said tail top, a vertical wall connection end connecting said tail to said tile-facing side and an opposite free end;

said tail bottom being flat, continuous and coplanar with said flat base portion of said vertical wall for engaging a flat floor surface and extending from said vertical wall to said free end, and a tail top portion extending from said tile-facing side intermediary portion of said tile-facing side and being inclined and extending downwardly from said tile-facing intermediary portion of said tile-facing side to said free end;

a cap on the wall top portion, said cap including a lip overhanging a portion of said tail and said lip not overhanging said carpet-facing side of said vertical wall, said lip being proximate said tile-facing side of said vertical wall and said lip having a rounded nose portion at a free end of said lip, and said cap having a carpet side edge on the side opposite of said cap from said lip;

a tile resting on said tail top, said tile having both an end edge portion disposed between said tail top and said lip, and a tile top surface for engaging said rounded nose portion of said lip; and a selected one of a carpet tile and a carpet, each of said carpet tile and said carpet comprising a carpet edge disposed against said carpet-facing side of said vertical wall.

9. The combination of a one-piece transition, a tile and the selected one of the group consisting of carpet tiles and a carpet according to claim 8 wherein said selected one of said carpet tile and said carpet comprises carpet fibers, and wherein said cap of said one-piece transition includes an upper level, and wherein said carpet fibers extend to said upper level to render said cap only partly noticeable to viewers of said transition.

* * * * *